United States Patent [19]

Portsmouth

[11] 4,441,648

[45] Apr. 10, 1984

[54] SINGLE PIECE PACKAGING CONTAINER

[75] Inventor: Joseph P. Portsmouth, White Plains, N.Y.

[73] Assignee: Nabisco Brands, Inc., Parsippany, N.J.

[21] Appl. No.: 366,634

[22] Filed: Apr. 8, 1982

[51] Int. Cl.[3] ..... B65D 5/06

[52] U.S. Cl. ..... 229/37 R; 229/40; 229/48 T

[58] Field of Search ..... 229/37 R, 61, 68 R, 229/40, 48 T

[56] References Cited

U.S. PATENT DOCUMENTS 2,481,380 9/1949 Anderson, Sr. ..... 229/40 X
4,008,650 2/1977 Alter et al. ..... 229/68 R X

FOREIGN PATENT DOCUMENTS 666265 7/1963 Canada ..... 229/37 R
143720 6/1935 Fed. Rep. of Germany .... 229/37 R
967576 8/1964 United Kingdom ..... 229/37 R

*Primary Examiner*—William Price
*Assistant Examiner*—Gary E. Elkins
*Attorney, Agent, or Firm*—R. Kornutik

[57] ABSTRACT

A hermetically sealed carton formed from a single die cut blank of laminated or coated paperboard stock having a uniquely configured bottom seal die cut requiring a minimum of seals at folded miters during setting up of the carton. The die cut blank comprises a bottom panel and first and second opposed side wall panels attached to opposed first and second edges thereof. Third and fourth opposed side wall panels are attached to opposed edges of the first side wall panel, while overlapping side sealing flaps are attached to opposed edges of the second side wall panel. The third and fourth opposed edges of the bottom and the bottom edges of the third and fourth side wall panels are formed with contiguous truncated triangular sealing flaps which are folded against the bottom of the carton during set up thereof.

8 Claims, 4 Drawing Figures

SINGLE PIECE PACKAGING CONTAINER

BACKGROUND OF THE INVENTION

1. Field of the Invention

The present invention relates generally to a container formed from a single die cut blank of paperboard and also to the blank from which it is formed. More particularly, the subject invention pertains to a low cost, hermetically sealed container formed from a single die cut blank in a manner which enables the container to be set up at a relatively high production rate compared with prior art cartons, thus resulting in a container which has substantial economic advantages relative to the prior art.

2. Discussion of the Prior Art

The present invention concerns a carton for products which for various reasons must be enclosed within a package having effective gas and moisture barrier properties. For example, certain products must be protected from exposure to water or moisture, or they may lump, cake, decompose, or otherwise become damaged or harmed. Similarly, other products may be deliberately packaged to include ingredients, such as water or moisture, which cannot be permitted to escape from the product without damaging it in some manner. Typical products which can be packaged in the carton of the present invention include a variety of liquids and solids in powdered, granular or crystalline form such as milk, concentrated fruit juices, powdered sugar, gelatin, salt, flour, cereals, dish-washing detergents and snack foods.

Several approaches have heretofore been used to package these troublesome products. In one approach, the product is packaged in a dual container in which the product is separately packaged within the container in a material having good moisture or gas barrier properties. Breakfast cereals and candies are examples of this type of packaging. In another approach, the material is packaged in a container overwrapped with a material such as a metallic foil which has effective moisture and gas barrier properties. These packages are generally undesirable because they are relatively expensive and, in some cases, require extra steps during the packaging operation which further increases the cost of packaging.

Hermetically sealed cartons of the aforementioned type are frequently formed from paperboard which is continuously manufactured on a paper machine and stored in large rolls. Subsequently, the paperboard is unrolled and directed through an extruder wherein polyethylene is extruded onto one or more surfaces of the paperboard to provide a coating. Thereafter, the thermoplastic coated paperboard is generally rerolled. The coated paperboard is fed into a press which cuts the continuous web of paperboard into container blanks of the desired size. Additionally, the same press may be employed to provide appropriate score lines which facilitate the folding and erecting of the container as well as any printing or art work. Thus, the resulting product is a flat, thermoplastic coated paperboard blank which has been appropriately cut and scored. Generally, at this point, the two longitudinal edges of the blank are joined so as to form a square tube. Commonly, the joining of the two longitudinal edges is achieved through a heat seal, i.e., the polyethylene coating adjacent to the two longitudinal edges is heated and the two heated edges are pressed together. Tubes of the type thus formed are generally sold in a flat condition, by the manufacturing company, to a processor.

When received by the processor, the paperboard tubes are usually sequentially fed into a so-called form, fill and seal machine. Typically, in such a machine, the paperboard tube which was shipped in a flat condition is formed into a square tube and deposited upon an upstanding, square mandrel. The tube is placed on the mandrel so that the part of the tube which will form the bottom of the container extends past the exposed end of the mandrel. Thereafter, the machine proceeds to position the carton under a heater which heats the polyethylene coating on the bottom forming flaps to a temperature at which the polyethylene coating will act as a bonding or adhesive agent. The machine then proceeds to manipulate the flaps extending past the end of the mandrel so as to form a bottom closure. When a bottom closure has been approximately formed by juxtaposing the integral flaps on the tube, the mandrel moves such that a series of cooled plates (pressure pads) are pressed against the formed bottom for a time sufficient to effect a heat seal between the bottom forming flaps. Thereafter, the open top container thus formed is stripped off the mandrel, filled with product and the top is appropriately sealed.

Paperboard cartons of the aforementioned type are disclosed by Arslanian U.S. Pat. No. 3,232,516, Braun U.S. Pat. No. 3,498,524 and Lisiecki U.S. Pat. No. 4,211,357, and are in common commercial usage for products such as milk and juices. Unfortunately, cartons of this type have a number of disadvantages including the following. Major portions of the bottoms of these containers are heat sealed together by four layers of paperboard, which frequently results in problems in their hermetic seals. Moreover, the bottoms of these cartons require a fair amount of detailed work to fold together, insert, and finally seal the various components of the container bottom which result in several disadvantages. The detailed assembly work of the bottom limits the production rate of these containers in a form, fill and seal production line to a present rate, depending upon carton size, of approximately fifty to one hundred and thirty units per minute. Moreover, the detailed insertion and folding together of the bottom component sections requires very accurate die cut blanks and finely adjusted packaging machine mechanisms.

These prior art containers have an additional disadvantage in that the partially assembled blanks received by a processor are difficult to aseptically treat with hydrogen peroxide or other aseptic solutions as they are already partially assembled.

SUMMARY OF THE INVENTION

Accordingly, it is a primary object of the present invention to provide a packaging container formed from a single die cut blank which is superior to prior art packaging containers and has particular utility in packaging applications requiring a hermetically sealed product.

A further object of the subject invention is the provision of a container structure of the aforementioned type which is constructed with a minimum of material cost and fabricating expense, and can be utilized in packaging lines at production rates significantly higher than are available with prior art containers.

Moreover, an additional object of the present invention is the provision of an economic functional container suitable for packaging liquids, powders or solids and having a hermetically sealed construction requiring no inner liner or bag. Moreover, the container can be formed from a single die cut blank of thermoplastic sheet material such that it can be effectively heat sealed at its seam areas. A further advantage of the present invention is that the initial flat blank can be easily and conveniently treated with an aseptic solution such as hydrogen peroxide prior to being formed into a container.

A further object of the invention is to provide a new and improved liquid-proof container bottom closure formed of thermoplastic sheet material which is strong, simple to erect, close and seal, and further is susceptible of high volume economical machine production. These advantages are provided by a novel container bottom closure construction having fold-in panels so designed that they can be automatically closed and heat-sealed. Further, the unique container bottom closure construction requires a minimum number of surfaces to be heat-sealed together at any one location to attain a hermetically sealed package.

In accordance with the teachings herein, the present invention provides a blank for forming a container, particularly a hermetically sealed container. The blank includes a bottom panel having first and second opposed side wall panels attached thereto at opposed side edges, which form horizontal fold lines. Third and fourth opposed side wall panels are attached to the side edges of either of the first and second side wall panels along vertical fold lines therebetween. Moreover, first and second bottom seam flaps are attached to the bottom edges of the third and fourth side wall panels, and third and fourth bottom seam flaps are attached to third and fourth opposed edges of the bottom panel.

In the disclosed embodiments, each of the bottom seam flaps has a shape forming at least a portion of a triangle, and in greater particularity a shape forming a truncated triangle. Moreover, the first and second bottom seam flaps are attached respectively to the third and fourth bottom seam flaps along a mutual triangular edge forming a fold line therebetween. Furthermore, the preferred embodiments include first and second side seam flaps attached to side edges of either of the first and second side wall panels which are adapted to form side seams with the third and fourth side wall panels, and the side seam flaps are connected to the third and fourth bottom seam flaps by triangular shaped extensions positioned therebetween.

BRIEF DESCRIPTION OF THE DRAWINGS

The foregoing objects and advantages of the present invention for a single piece packaging container may be more readily understood by one skilled in the art with reference being had to the following detailed description of several preferred embodiments thereof, taken in conjunction with the accompanying drawings wherein like elements are designated by identical reference numerals through the several views, and in which.

DETAILED DESCRIPTION OF THE DRAWINGS

Figure 1:
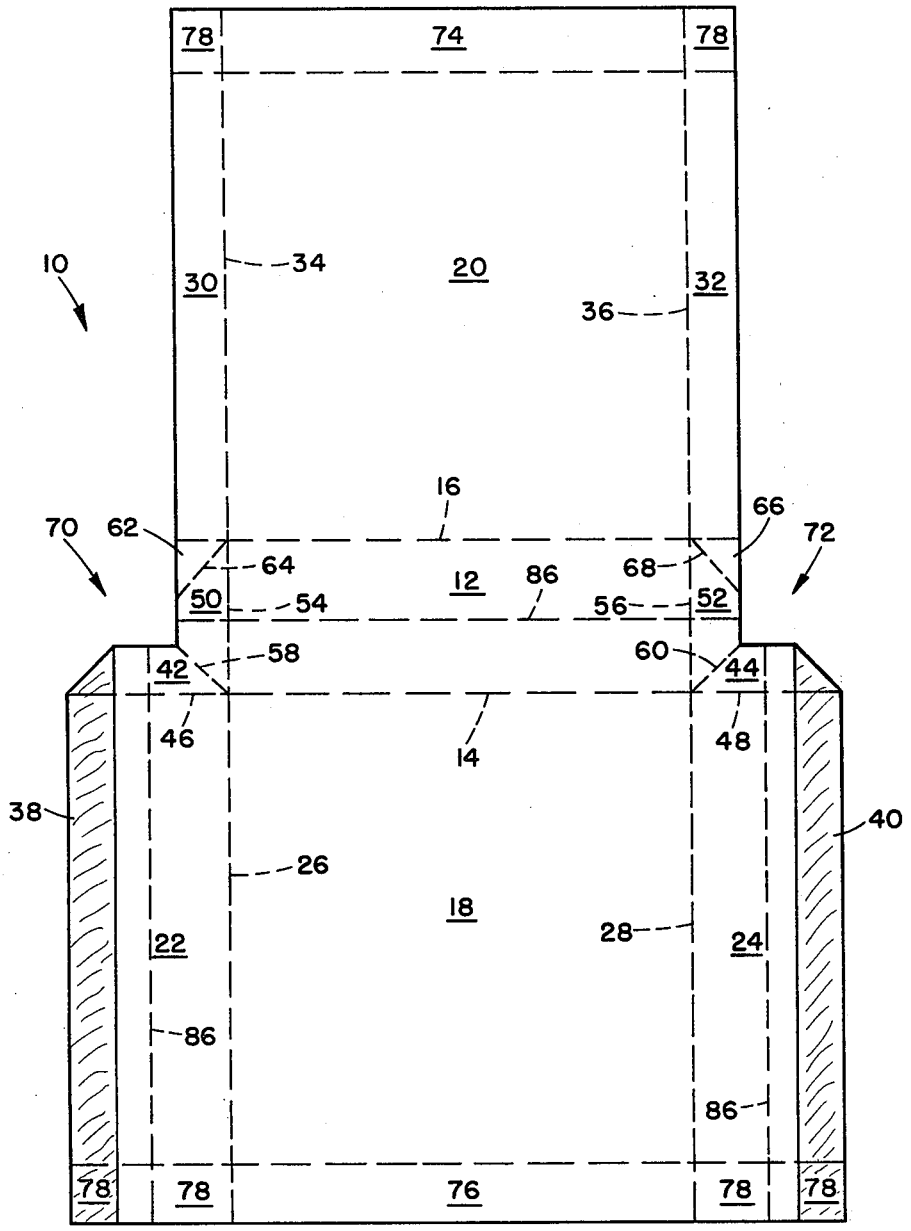
FIG. 1 is a plan view of an exemplary embodiment of a single die cut blank constructed pursuant to the teachings of the present invention.

Referring to the drawings in detail, FIG. 1 is a plan view of an exemplary embodiment of a die cut single blank 10 constructed pursuant to the teachings herein. The blank 10 has a generally rectangular bottom panel 12 having first and second opposed edges 14 and 16, to which are attached first and second opposed generally rectangular side wall panels 18 and 20. After completion of the set up of the carton, the edges 14 and 16 form horizontal fold lines between the horizontal bottom panel 12 and the vertically extending side wall panels 18 and 20.

Third and fourth opposed, generally rectangular, side wall panels 22 and 24 are attached to the side edges 26 and 28 of the first side wall panel 18. After completion of the set up of the carton, the edges 26 and 28 form vertical fold lines between the first side panel 18 and the third and fourth side panels 22 and 24.

The second side panel 20 has a pair of side seam flaps 30 and 32 attached to its side edges 34 and 36. During the set up of the carton, the edges 34 and 36 form vertical fold lines, and the seam flaps 30 and 32 overlap the shaded seam areas 38 and 40 of the third and fourth side panels 22 and 24 to which they are hermetically sealed.

A pair of first and second bottom seam flaps 42 and 44, each having a truncated triangular shape, extend from the bottom edges 46 and 48 of the third and fourth side panels. Likewise, a pair of third and fourth bottom seam flaps 50 and 52, each having a truncated triangular shape, extend from the opposed third and fourth edges 54 and 56 of the bottom panel. The first bottom seam flap 42 and the third bottom seam flap 50 are joined along a mutual triangular edge 58, at which the blank is folded 180° during set up of the carton. Likewise, the second bottom seam flap 44 and the fourth bottom seam flap 52 are joined along a mutual triangular edge 60, at which the blank is folded 180° during set up of the carton. In a similar manner, a bottom triangular extension 62 of the side seam flap 30 and the third bottom seam flap 50 are joined along a mutual triangular edges 64, at which the blank is folded 180° during set up of the carton. Likewise, a bottom triangular extension 66 of the side seam flap 32 and the fourth bottom seam flap 52 are joined along a mutual triangular edge 68 at which the blank is folded 180° during set up of the carton.

During construction of a carton from the blank of FIG. 1, the blank is folded at the bottom panel edges 14 and 16 such that the first and second sides 18 and 20 extend upwardly from the bottom panel 12. The third and fourth side panels 22 and 24 are then folded relative to the first side panel 18 at the vertical edges 26 and 28 and also along the common bottom seam flap edges 58 and 60. The side seam flaps 30 and 32 are folded (towards the third and fourth sides 22 and 24) relative to the second side panel 20 at the vertical edges 34 and 36 and also along the bottom seam flap edges 64 and 68. The side seam flaps 30 and 32 are then overlapped (Underneath) with respect to the seam areas 38 and 40 of the third and fourth side wall panels 22 and 24 and are sealed with respect thereto.

Figure 3:
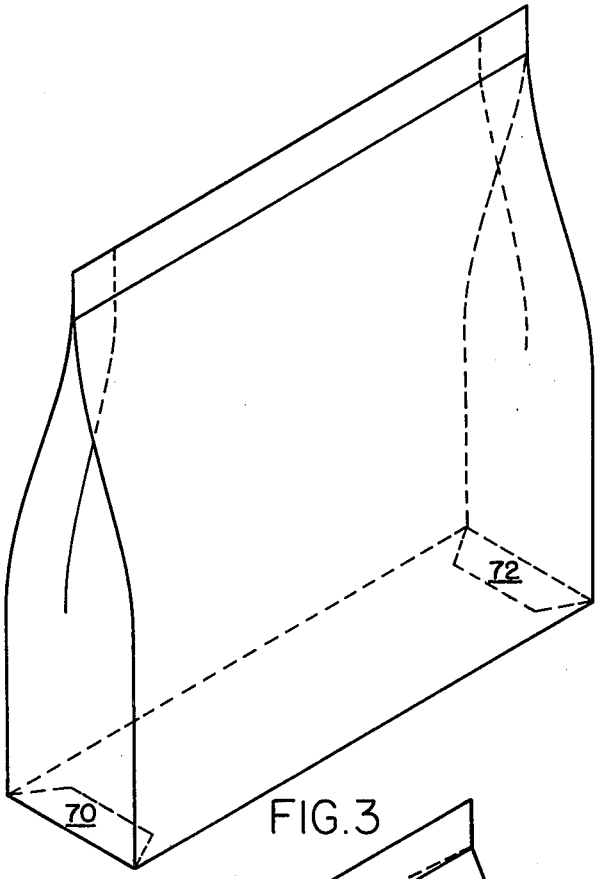
FIG. 3 illustrates the manner in which the bottom of the blank of FIG. 1 is folded together to form a hermetically sealed carton.

At this intermediate stage of construction the side wall panels are all attached to each other, and a pair of miter tabs 70 and 72 vertically depend from the third and fourth opposed edges 54 and 56 of the bottom panel 12. Each miter tab includes a double thickness of the blank material (42 overlapped with 50 and 44 overlapped with 52) except for the regions of the triangular areas 62, 66 at which there is a triple thickness of blank material. The miter tabs 70 and 72 are then folded along bottom edges 54,56 against the bottom 12, and a combined heat and pressure treatment is applied over the miter tabs 70 and 72 to form a hermetically sealed bottom for the container. The final position of the miter tabs 70 and 72 is illustrated in FIG. 3.

Figure 4:
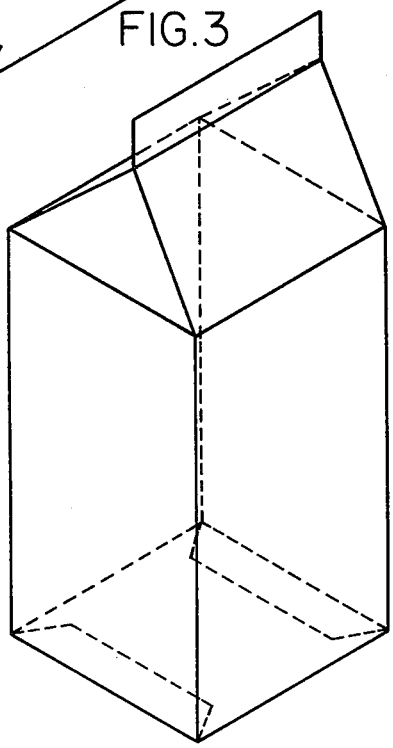
FIG. 4 is a schematic illustration of a generally square gable top carton constructed pursuant to the teachings of the present invention.

The construction of the top of the container can be of any conventional type as it is not considered to be a novel feature of the present invention. For instance, the top can be simply folded together and seamed along top seams 74 and 76, with the top side seam areas 78 being folded in 180° with respect to the seam areas 74 and 76 to form a resultant container as illustrated in FIG. 3. Alternatively the container could have a conventional gable type top as shown in FIG. 4, or could be conventional slant top or a conventional square top. Any of these types of container tops is capable of being hermetically sealed in a conventional and known manner, and accordingly the details thereof will not be discussed herein.

Figure 2:
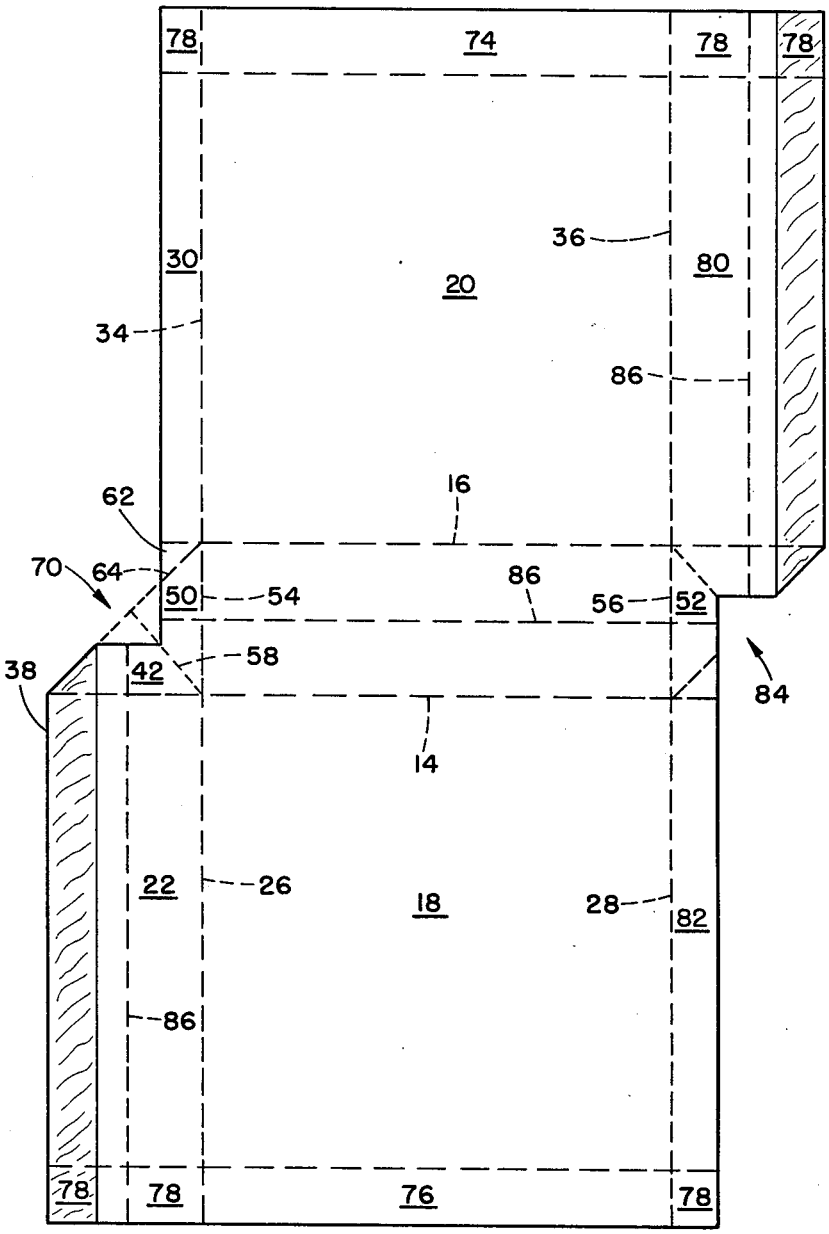
FIG. 2 illustrates a plan view of a second embodiment of a single die cut blank according to the subject invention.

FIG. 2 illustrates a second embodiment of the present invention similar in concept to that of FIG. 1, but wherein the fourth side wall panel 24 of FIG. 1 has been replaced by a symmetrically transposed fourth side panel 80 attached at vertical fold line 36 to the second side panel 20, and the side seam flap 32 has been replaced by a symmetrically transposed side seam flap 82 attached at vertical fold line 28 to the first side panel 18. The details of the miter tab 84 are also symmetrically transposed with respect to the miter tab 72. In concept, the embodiment of FIG. 2 is essentially the same as that of FIG. 1, and accordingly will not be explained further herein.

The miter tab 70 of FIG. 2 also illustrates in dashed lines a further variation of the embodiment of FIG. 1 wherein the truncated triangular bottom seam flaps 42 and 50 can be constructed as full triangular bottom seam flaps. The truncated construction appears to be preferred, however, as it eliminates two sharp exterior corners on the bottom of the fully set up container.

FIG. 4 also illustrates the concept that the principles of the present invention are applicable to containers having different rectangular shapes, such as square bottom containers or other alternative rectangular shapes.

The carton blank of the present invention can be formed of any suitable material such as paperboard stock coated on one or both sides with a suitable thermoplastic sealant such as polyethylene, Surlyn or polyester. The coating of sealant serves as a moisture and grease barrier, thereby allowing the construction of a hermetically sealed carton. Furthermore, the sealant coating eliminates the need for glued seam areas as the carton blank is subjected to combined heat and pressure at the seam areas during set up of the carton, which melts the adjacent thermoplastic coatings to form hermetic seams. In this regard, one distinct advantage of the present invention over the prior art is that the number of adjacent blank layers which are pressed and heated together to form hermetic seams is minimized. In a typical hermetically sealed carton in commercial usage today, major portions of the bottom are sealed by four layers of paperboard which are pressed and heated together to form the hermetically sealed container bottom. In contrast therewith, with the present invention, the hermetic seals at the carton bottom only comprise the relatively small areas of the miter tabs 70 and 72, which mainly comprise three layers of paperboard, except for the small regions of the triangular areas 62,66 which have four adjacent layers of paperboard. Although the embodiments of the present invention discussed thus far are constructed with thermoplastic coating sealed seams, other embodiments could also utilize glued seams, either in conjunction with thermoplastic coated paperboard or another type of stock material.

The subject invention also has a further distinct advantage over the aforementioned prior art approach in that only a minimal amount of detailed work is required to fold and seal the miter tab joints. This beneficial attribute would allow the capability of a production line rate of approximately two hundred units per minute, compared to prior art production rates of only fifty to one hundred and thirty units per minute, depending upon the carton size. Moreover, one type of hermetically sealed container in common usage in the prior art requires very accurate die cuts and finely adjusted packaging machine mechanisms as the container bottom requires the insertion of one folded bottom seam flap into a second folded bottom seam flap. The present invention does not require any comparable insertion of bottom seam flaps, and accordingly is capable of being implemented at greater production rates with less precise die cut blanks and packaging machine mechanisms.

The present invention can be supplied to a processor as a partially set up blank, sealed at the side seams 38 and 40 and folded along lines 86 in the center of the side and bottom panels, in which case the processor would complete all further sealing and seaming operations during the packaging process. Alternatively, the subject invention could be supplied as a flat blank, as shown in FIGS. 1 and 2, in which event the blanks would be utilized in a form, fill and seal packaging machine. One advantage of this latter arrangement is that the blanks can be easily and conveniently treated with an aseptic solution such as hydrogen peroxide prior to being formed into a container.

While several embodiments and variations of the present invention for a single piece packaging container are described in detail herein, it should be apparent that the disclosure and teachings of the present invention will suggest many alternative designs to those skilled in the art.

What is claimed is:

1. A hermetically sealed container formed from a single piece blank of heat sealable material while requiring a minimum number of surfaces to be heat sealed together at any one location, comprising:

a. a horizontal bottom panel;

b. first and second opposed, substantially vertical side wall panels attached through 90° folds to first and second opposed edges of said bottom panel;

c. third and fourth opposed, substantially vertical side wall panels attached through 90° folds to side edges of at least one of said first and second side wall panels, with said first and second vertical side wall panels being attached, adjacent two side corners of the carton, by two vertically extending seal seams to the third and fourth vertical side wall portions;

d. first and second bottom seam flaps attached through 90° folds to the bottom edges of said third and fourth side wall panels and extending along and adjacent to said bottom panel; and e. third and fourth bottom seam flaps attached through 180° folds to third and fourth opposed edges of said bottom panel and extending along and adjacent to said first and second bottom seam flaps and said bottom panel, with the arrangement comprising said third bottom seam flap being folded over through 180° and overlaying and being sealed directly to said horizontal bottom panel, and said first bottom seam flap being folded over through 90° and overlaying, and at least a major portion of the first bottom seam flap being sealed directly to, the third bottom seam flap, such that a major portion of the seal between the horizontal bottom panel, the third bottom seam flap and the first bottom seam flap is comprised of only three carton surfaces sealed directly together, and no more than four carton surfaces are sealed together over the entire seal, and the arrangement further comprising said fourth bottom seam flap being folded over through 180° and overlaying and being sealed directly to said horizontal bottom panel, and said second bottom seam flap being folded over through 90° and overlaying, and at least a major portion of the second bottom seam flap being sealed directly to, the fourth bottom seam flap, such that a major portion of the seal between the horizontal bottom panel, the fourth bottom seam flap and the second bottom seam flap is comprised of only three carton surface sealed directly together, and no more than four carton surfaces are sealed together over the entire seal.

2. A container as claimed in claim 1, each of said first, second, third and fourth bottom seam flaps having a shape forming at least a portion of a triangle.

3. A container as claimed in claim 2, each of said first, second, third and fourth bottom seam flaps having a shape forming a truncated triangle.

4. A container as claimed in claim 2, said first bottom seam flap being attached to said third bottom seam flap along a mutual triangular edge forming a fold line therebetween, and said second bottom seam being attached to said fourth bottom seam flap along a mutual triangular edge forming a fold line therebetween.

5. A container as claimed in claim 1 or 4, including first and second side seam flaps attached to side edges of at least one of said first and second side wall panels and forming side seams with said third and fourth side wall panels.

6. A container as claimed in claim 5, said first and second side seam flaps being connected to said third and fourth bottom seam flaps by triangular shaped extensions positioned therebetween.

7. A hermetically sealed container as claimed in claim 1 or 2 or 3 or 4, said container being formed of paperboard coated with a moisture-proof sealant which also forms the seams of the hermetically sealed carton.

8. A hermetically sealed container as claimed in claim 1, further including a minor portion of the seal between the horizontal bottom panel and the first and third bottom seam flaps including a fourth fold surface, such that a maximum of four carton surfaces comprise a minor portion of the seal between the horizontal bottom panel and the first and third bottom seam flaps, and a minor portion of the seal between the horizontal bottom panel and the second and fourth bottom seam flaps including a fourth fold surface, such that a maximum of four carton surfaces comprise a minor portion the seal between the horizontal bottom panel and the second and fourth bottom seam flaps.

* * * * *